US005764149A

United States Patent [19]

Patel et al.

[11] Patent Number: 5,764,149

[45] Date of Patent: *Jun. 9, 1998

[54] ENHANCED CAPABILITIES OF SMOKE DETECTORS

[75] Inventors: Jayant D. Patel, Lake Forest, Calif.; Brian Matthews, Kirkland, Wash.

[73] Assignee: McDonnell Douglas Corporation, Long Beach, Calif.

[ * ] Notice: The term of this patent shall not extend beyond the expiration date of Pat. No. 5,625,346.

[21] Appl. No.: 738,609

[22] Filed: Oct. 29, 1996

[51] Int. Cl.[6] ..... G08B 17/10

[52] U.S. Cl. ..... 340/628; 340/606; 340/693; 454/234

[58] Field of Search ..... 340/628–630, 340/632, 577–579, 584, 691–693, 606; 250/381, 573; 116/214; 454/234, 237, 257

[56] References Cited

U.S. PATENT DOCUMENTS

| | | | |
|---|---|---|---|
| 3,876,999 | 4/1975 | Lee | 340/606 |
| 4,035,788 | 7/1977 | Barr | 340/628 |
| 4,305,069 | 12/1981 | Machen et al. | 340/628 |
| 4,617,560 | 10/1986 | Gutmann | 340/628 |
| 4,665,311 | 5/1987 | Cole | 250/574 |
| 4,764,758 | 8/1988 | Skala | 340/628 |
| 4,972,081 | 11/1990 | Dumbeck, Sr. | 250/380 |
| 5,103,212 | 4/1992 | Notarianni et al. | 340/628 |
| 5,182,542 | 1/1993 | Adelman et al. | 340/628 |
| 5,231,378 | 7/1993 | Dennis et al. | 340/628 |
| 5,625,346 | 4/1997 | Shim et al. | 340/628 |

*Primary Examiner*—Jeffery Hofsass
*Assistant Examiner*—Daniel J. Wu
*Attorney, Agent, or Firm*—Bell Seltzer Intelluctual Property Law Group of Alston & Bird LLP

[57] ABSTRACT

A smoke detector which includes a cover that is attached to a housing base by a mechanical latch. The housing contains a fan that induces an airflow through the housing, a smoke detector that can detect smoke in the airstream, and a flow sensor that can measure the flowrate created by the fan. The flow sensor and fan can be captured by plates that slide into inner walls of the housing and are secured by the cover. The cover also has a latch for securing a grill to the smoke detector housing.

12 Claims, 1 Drawing Sheet

ENHANCED CAPABILITIES OF SMOKE DETECTORS

BACKGROUND OF THE INVENTION

1. Field of the Invention

The present invention relates to a smoke detection system for an aircraft.

2. Description of Related Art

Large commercial aircraft typically contain smoke detectors which detect smoke and provide an indication that a fire may exist within the vehicle. The smoke detector is typically mounted to the fuselage above the ceiling of the passenger and/or cargo compartment. Aircraft specifications require smoke detection much sooner than detection within a building structure. To decrease the detection time, a duct is installed into the aircraft to channel a stream of air from the passenger compartment to the detector. The duct is typically coupled to the airplane vent system which provides a flow of air into the smoke detector.

The smoke detector duct adds weight to the vehicle, thereby reducing the fuel efficiency of the airplane. The duct and detector also require various fasteners to install, thereby increasing the cost of producing the aircraft. It would be desirable to provide a smoke detection system for an aircraft which did not require additional ducts to couple the detector to the passenger and/or cargo compartment of the plane. It would also be desirable to provide a smoke detector that minimized the amount of fasteners required to assemble the device to lower the cost and space required to produce the aircraft.

SUMMARY OF THE INVENTION

The present invention is a smoke detector which includes a cover that is attached to a housing base by a mechanical latch. The housing contains a fan that induces an airflow through the housing, a smoke detector that can detect smoke in the airstream, and a flow sensor that can determine if an adequate flowrate is created by the fan. The flow sensor and fan can be captured by plates that slide into inner walls of the housing and are secured by the cover. The cover also has a latch for securing a grill to the smoke detector housing.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
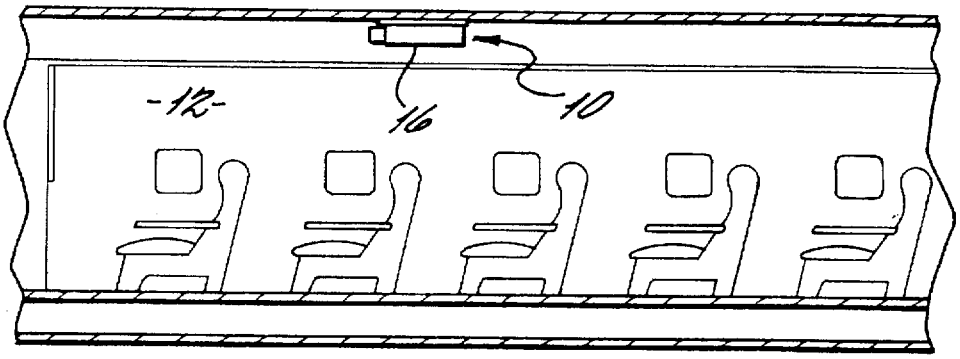
FIG. 1 is a side view of a smoke detector unit located above the passenger and/or cargo compartment ceiling of an aircraft.

Referring to the drawings more particularly by reference numbers, FIG. 1 shows a smoke detector unit 10 of the present invention. The smoke detector 10 is typically mounted to the fuselage 12 of a commercial aircraft. Although the detector 10 is shown and described mounted to an aircraft, it is to be understood that the detector unit 10 of the present invention can be attached to other structures such as a residential or commercial building.

Figure 2:
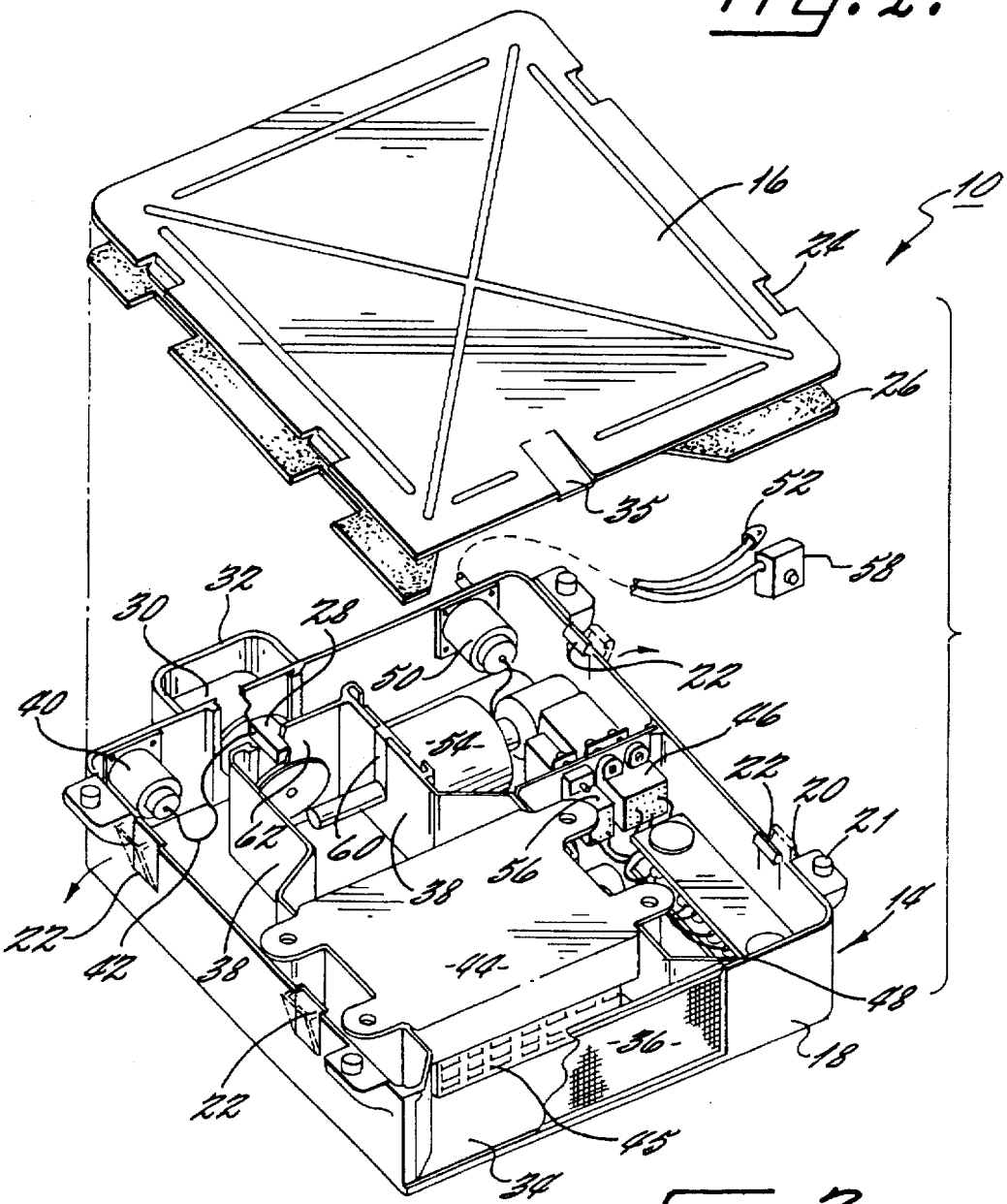
FIG. 2 is a perspective view showing the components of the smoke detector.

As shown in FIG. 2, the detector unit 10 includes a housing 14. The housing 14 may be assembled from a cover

16 that is attached to a base member 18. The cover 16 and base member 18 are preferably constructed from a molded plastic material that is lightweight and relatively inexpensive to produce. The base member 18 may have a plurality of ears 20 with studs 21 that are pressed into corresponding holes (not shown) in the fuselage frame 12 for ease of installation in the aircraft.

The base member 18 may have a number of latches 22 that snap into corresponding lips 24 in the cover plate 16 to attach the cover 16 to the base 18. The latches 22 can be deflected in an outward direction to open the cover 16 and provide access to the inside of the unit 10. The outer wall of the base member 18 is flexible enough to allow an operator to deflect the latches 22 with minimal physical exertion. The underside of the cover 16 may have a gasket 26 to seal the edges of the housing 14. The latches 22 allow the cover 16 to be attached to the base member 18 without using any fasteners, thereby minimizing the assembly time and cost of installing the smoke detector into an aircraft. Additionally, the latches 22 allow an operator to remove the cover with one hand further simplifying any subsequent repair or maintenance of the smoke detector 10.

Within the unit 10 is a fan 28 that creates a flow of air through the housing 14. In the preferred embodiment, the fan 28 creates an airflow ranging between 14–17 cubic feet per minute (CFM). The fan 28 is located within an opening 30 in the housing 14. The opening 30 may have a duct 32 to direct the air from the fan 28. The fan 28 typically pulls air through a grill 34 located at the opposite end of the housing 14. The grill 34 is secured to the base member 18 by the cover 16. The cover 16 may have a grill latch 35 that can be deflected to detach the grill 34 from the base member 18.

Although the fan 28 is described as pulling air from opening 34 to opening 30, it is to be understood that the fan 28 can pull air from opening 30 to opening 34. The opening 34 may have a filter 36 that filters out non-smoke impurities from the airstream. The filtered impurities may be substances that provide a false detection of smoke. The inner cavity of the housing 14 may also have a pair of walls 38 that provide a duct that guides the flow of air through the housing 14. The fan 28 is connected to an external source of electrical power through connector 40 and wires 42.

Located between the walls 38 of the housing 14 is a smoke detector 44 which detects the presence of smoke in the air that flows through the unit 10. The smoke detector 44 may have a photoelectric sensor which provides an output signal when the content of smoke exceeds a predetermined threshold level. The smoke detector 44 contains an inner passage 45 that allows the air to flow through the detector 44 from the grill 34 to the fan 28.

The smoke detector 44 is coupled to a first latching relay 46 by an electrical terminal board 48. The terminal board 48 is coupled to the external structure by connector 50. The first relay 46 is typically connected to an indicator light 52 and/or an indicator readout located in the cockpit of the aircraft. When the smoke detector 44 detects an excessive amount of smoke in the airstream, the detector 44 provides an output signal which actuates the relay 46 and provides an indication that smoke has been detected. The relay 46 is latching so that the indicator light 52 remains on even when the content of smoke falls below the threshold level. In the preferred embodiment, the first relay 46 is a 22 second latching relay device.

Located between the fan 28 and the smoke detector 44 is a flow sensor 54 which senses the presence of airflow through the housing 14. The flow sensor 54 is connected to the external indicator light 52. The unit also has a second relay 56 that is coupled to the first relay 46 and an external button 58, typically located in the cockpit of the aircraft. The second relay 56 de-activates the first relay 46.

Depressing the external button 58 provides power to the flow sensor 54 and the smoke detector 44. The flow sensor 54 operates as a switch between the external button 58 and the smoke detector 44. If there is an adequate flow of air through the housing 14, the flow sensor 54 switch is closed and power is provided to the smoke detector 44. Power to the smoke detector 44 will initiate a self-diagnostic test within the detector 44. If the smoke detector 44 is functioning properly, an output signal is provided to the indicator light 52 to provide an indication that the unit is operating properly. The second relay 56 de-activates the first relay 46 so that the output of the smoke detector 44 is not latched when the external button is depressed.

The flow sensor 54 is captured by a T-shaped plate 60 that slides into a corresponding slot of the wall 38. Additionally, the fan 28 is captured by a pair of plates 62 that slides into a corresponding slot of the wall 38. The plates 60 and 62 for the fan 28 and flow sensor 54, respectively, are secured to the base member 18 by the bottom surface of the cover 16. The plates 60 and 62 secure the flow sensor 54 and fan 28 while minimizing the number of fasteners required to assemble the smoke detector 10.

In operation, the fan 28 creates a flow of air that passes through the smoke detector 44. If a threshold level of smoke is detected, the detector 44 will switch the relay 46 to provide an indication in the cockpit of the existence of smoke. To test the system, the pilot can depress the external button to insure that the detector is operating properly and that there is a sufficient flow of air through the detector 44. Pulling the air through the smoke detector has been found to reduce the time required to detect smoke.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A smoke detector, comprising:

a base member that has a latch;

a smoke detector that is located within said base member;

a fan that is located within said base member;

a flow sensor that is located within said base member; and, a cover that is attached to said base member by said latch.

2. The smoke detector as recited in claim 1, further comprising a plate that slides into a wall of said base member to secure said flow sensor.

3. The smoke detector as recited in claim 2, wherein said plate is held in place by said cover.

4. The smoke detector as recited in claim 1, wherein said latch engages a lip of said cover.

5. The smoke detector as recited in claim 1, further comprising a plate that slides into a wall of said base member to secure said fan.

6. The smoke detector as recited in claim 1, further comprising a grill that is secured to said base member by a grill latch of said cover.

7. A smoke detector assembly for an aircraft, comprising:

a base member that is mounted to a fuselage of the aircraft, said base member having a latch;

a smoke detector that is located within said base member;

a fan that is located within said base member;

a flow sensor that is located within said base member; and, a cover that is attached to said base member by said latch.

8. The smoke detector assembly as recited in claim 7, further comprising a plate that slides into a wall of said base member to secure said flow sensor.

9. The smoke detector assembly as recited in claim 8, wherein said plate is held in place by said cover.

10. The smoke detector assembly as recited in claim 7, wherein said latch engages a lip of said cover.

11. The smoke detector assembly as recited in claim 7, further comprising a plate that slides into a wall of said base member to secure said fan.

12. The smoke detector assembly as recited in claim 7, further comprising a grill that is secured to said base member by a grill latch of said cover.

* * * * *